US005372114A

United States Patent [19]

Gant et al.

[11] Patent Number: 5,372,114

[45] Date of Patent: Dec. 13, 1994

[54] DAMPENED PRESSURE REGULATING AND LOAD CELL TAPPET

[75] Inventors: Gary L. Gant; P. Douglas Free; James R. Katzenmeyer; Donald E. Duckworth; George L. Muntean, all of Columbus, Ind.

[73] Assignee: Cummins Engine Company, Inc., Columbus, Ind.

[21] Appl. No.: 142,983

[22] Filed: Oct. 29, 1993

[51] Int. Cl.[5] ..... F02M 37/04; F01L 1/34; F01L 1/14

[52] U.S. Cl. ..... 123/502; 123/90.16; 123/90.48

[58] Field of Search ..... 123/90.16, 90.48, 90.49, 123/90.55, 467, 501, 500, 502, 506, 508, 198 F, 496

[56] References Cited

U.S. PATENT DOCUMENTS

| | | | |
|---|---|---|---|
| 3,385,274 | 5/1968 | Shunta et al. | 123/90.16 |
| 3,742,921 | 7/1973 | Rendine | 123/90.16 |
| 4,249,499 | 2/1981 | Perr | 123/502 |
| 4,254,749 | 3/1981 | Krieg et al. | 123/502 |
| 4,395,979 | 8/1983 | Perr | 123/90.16 |
| 4,407,241 | 10/1983 | Butler et al. | 123/90.16 |
| 4,419,977 | 12/1983 | Hillebrand | 123/508 |
| 4,452,186 | 6/1984 | List et al. | 123/90.16 |
| 4,796,573 | 1/1989 | Wakeman et al. | 123/90.16 |
| 4,919,089 | 4/1990 | Fujiyoshi et al. | 123/90.16 |
| 4,977,867 | 12/1990 | Rhoads | 123/90.49 |
| 5,161,500 | 11/1992 | Kubis et al. | 123/90.48 |
| 5,193,496 | 3/1993 | Krüger | 123/90.16 |

*Primary Examiner*—E. Rollins Cross
*Assistant Examiner*—Thomas N. Moulis
*Attorney, Agent, or Firm*—Sixbey, Friedman, Leedom & Ferguson

[57] ABSTRACT

A hydraulic tappet for use in the fuel injector drive trains of compression ignition or diesel internal combustion engines are provided which optimize injector timing for improved fuel economy. One embodiment of the hydraulic tappet of the present invention includes a dampened pressure regulating feature which determines blow down pressure. A second embodiment of the hydraulic tappet of the present invention includes a dampening load cell feature which allows the blow down pressure of the load cell to be increased and injection timing to be optimally advanced.

15 Claims, 3 Drawing Sheets

DAMPENED PRESSURE REGULATING AND LOAD CELL TAPPET

TECHNICAL FIELD

The present invention relates generally to internal combustion engine injector tappets and specifically to injector tappets that are regulated and dampened to optimize injector timing for improved fuel economy.

BACKGROUND ART

Improving fuel economy is a continuing goal sought to be reached by internal combustion engine designers and manufacturers. Fuel injectors and their associated components have long been the focus of design improvements to achieve this objective. In addition, the elimination or reduction of injector carboning and corrosion are problems indirectly affecting fuel economy also sought to be solved. Advancing injection timing at higher loads will additionally result in improved engine performance and fuel economy and, consequently, is also a goal of engine designers.

Compression ignition or diesel engine manufacturers have long sought a reliable and consistent means for altering injection timing to enhance fuel economy. The injectors in a typical diesel engine are operated by a camshaft with a plurality of precisely defined lobe profiles positioned radially in a timed rotational relationship. Each lobe is connected to a camshaft-operated injector by a mechanical linkage which produces a rigid timing program that is not easily altered. Variable length hydraulic tappets positioned between the camshaft and injectors alter the engine timing by selectively lengthening the timing drive train, which changes the effective profile of the camshaft. When a hydraulic tappet is collapsed or shortened, the injector functions in its normal timing sequence. When the tappet is lengthened by trapping hydraulic fluid in an internal tappet chamber, the drive train between the camshaft and injector is lengthened which advances the normal timing sequence. If it is desired to retard timing, the tappet can be selectively collapsed to shorten the drive train. However, the use of variable length hydraulic tappets to advance injection timing has been found to be unsuitable for highly loaded unit fuel injectors because of a variety of problems, including that of secondary injection which leads to increased particulate levels.

A pressure limiting hydraulic tappet useful with a highly loaded fuel injector to advance timing is disclosed in U.S. Pat. No. 4,395,979 to Perr. This hydraulic tappet selectively varies the effective profile of the camshaft by extending the drive train between the camshaft and injector and contracting when the drive train pressure reaches a predetermined maximum. This tappet is pressure limiting and, therefore, does not collapse when the predetermined pressure is reached, thus forming a load cell. Although this hydraulic tappet allows better control over injection timing than tappets without a pressure limiting feature, the load is not maintained at a constant level during blow down, and it operates at lower loads than necessary to optimize injection timing.

Another type of pressure limiting hydraulic tappet is described in U.S. Pat. No. 4,407,241 to Butler et al. This tappet includes an expandable piston which defines a load cell chamber with selectively opened inlet and exit valves. The exit valve has one or more exit flow rates which are altered in response to the load cell chamber pressure. The closing of the exit valve is eased by dampening means. This tappet arrangement also provides better control over injection timing than many designs; however, the blow down pressure of the load cell cannot be increased to advance injection tinting to improve fuel economy.

U.S. Pat. No. 4,254,749 to Krieg et al discloses a device for hydraulically altering fuel injection timing in response to a high pressure fluid signal. This device does not include dampening structure, however, and thus does not control the impact load on the plunger or allow blow down pressure to be increased. As a result, optimum fuel economy is not likely to be attained with this structure.

The prior art, therefore, has failed to provide a dampened or pressure regulating load cell injector tappet which allows the blow down pressure of the load cell to be increased, thus optimally advancing injection timing at higher loads for improved fuel economy. A need for such an injector tappet exists to optimize injection timing and improve fuel economy.

SUMMARY OF INVENTION

It is a primary object of the present invention, therefore, to overcome the deficiencies of the prior art and to provide improved fuel injector tappets with dampened pressure regulating and dampened load cell capabilities.

It is another object of the present invention to provide fuel injector tappets capable of operating at high pressure loads.

It is a further object of the present invention to provide fuel injector tappets which advance injection timing to produce improved fuel economy.

It is still another object of the present invention to provide a fuel injector tappet which prevents secondary injection and the production or particulates.

It is still a further object of the present invention to provide a fuel injector tappet which decreases metering chamber temperatures to reduce carboning and corrosion.

The aforesaid objects are satisfied by providing a fuel injector tappet with a dampened pressure regulating feature and a dampened load cell feature. One embodiment of the fuel injector tappet of the present invention includes a load cell and a regulating plunger controlled to move reciprocally to vary the area of a spill port to equalize the pressure in the tappet plunger cavity and the load cell spring force. The fuel injector tappet of the present invention further includes a dampening cavity formed by a load cell plunger and the lower socket of the tappet main plunger to control the impact load by slowing the movement of the load cell plunger. This allows the blow down pressure of the load cell to be increased and injection timing to be advanced.

Other objects and advantages will be apparent from the following description, claims and drawings.

DETAILED DESCRIPTION OF THE PREFERRED EMBODIMENTS

Improvements in fuel consumption and fuel economy for nonelectronic fuel injection systems so that they are sufficiently lower in cost than electronic fuel injection systems are achieved by the dampened pressure regulating and load cell tappets of the present invention. The dampened pressure regulating tappet is designed to provide a constant load during blow down and to operate at higher loads, which allows the injection timing to be optimized for fuel economy. The constant load during blow down assures that the injector plunger is seated and prevents secondary injection, which decreases particulate formation. Additionally, the increased load carrying ability of the dampened regulating tappet allows the injection timing to be advanced at higher loads. The dampened load cell tappet is designed to increase the blow down pressure in the tappet while maintaining reasonable impact loads. This allows the injection timing to be advanced and produces decreased metering chamber temperatures to reduce carboning and corrosion.

Figure 1:
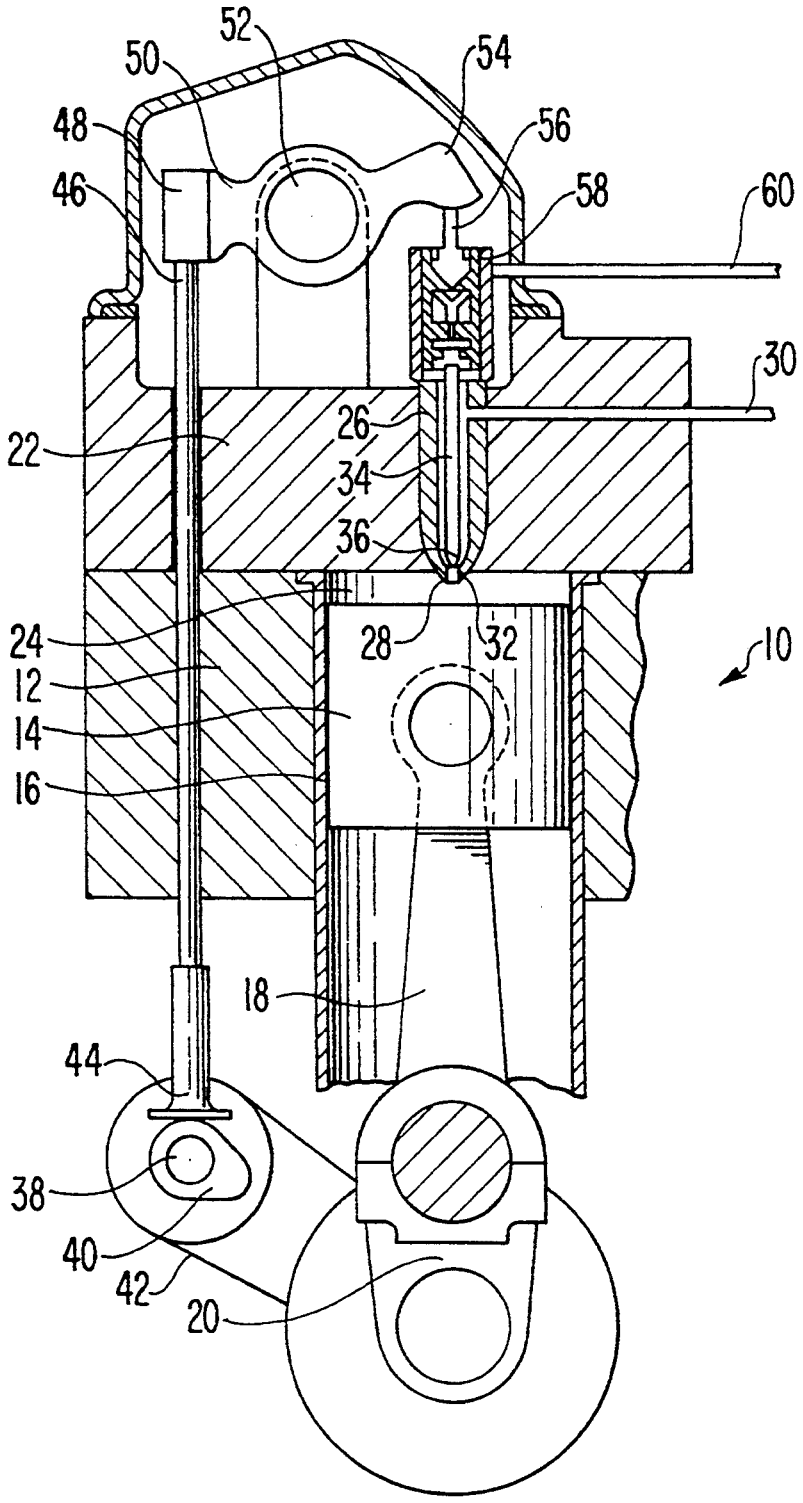
FIG. 1 illustrates schematically one cylinder of a compression ignition internal combustion engine with a fuel injector tappet according to the present invention positioned in the drive train between the camshaft and the fuel injector.

Referring to the drawings, FIG. 1 illustrates the fuel injector drive train and associated structures in a conventional compression ignition or diesel engine. This type of engine typically includes a number of cylinders like cylinder 10 in a cylinder block 12. Only one cylinder is shown in FIG. 1. Each cylinder includes a piston 14 mounted to reciprocate within a cylinder liner 16 inserted into a cylinder bore in the cylinder block 12. A connecting rod 18 joins the piston 14 to the engine crankshaft 20. A cylinder head 22 is secured to the cylinder block to define a combustion chamber 24 which extends above the piston and is bounded by the cylinder liner 16.

A fuel injector 26 is mounted to extend through the cylinder head 22 so that the injector tip 28 is inside the compression chamber 24. Fuel is supplied to the injector through a fuel line 30. The fuel enters the injector and is metered to the sac 32 in the fuel injector tip 28 by the metering scheme in effect for the engine. The fuel injector shown has a reciprocating injector plunger 34 with a pointed end 36 that fits into the sac 32 to force fuel into the combustion chamber 24.

A camshaft 38, which has a number of specifically configured lobes 40 formed in a predetermined timed rotational relationship to one another, is rotatably mounted in the cylinder block. The camshaft 38 is connected to the crankshaft 20 by a connector 42 which maintains the camshaft and crankshaft in a fixed timing relationship and which also coordinates the movement of a cam follower 44 and the piston 14. The connector 42 may be a gear, a chain or some other kind of commonly used timing connection device.

The cam follower 44 is attached to one end of a pushrod 46, and the other end of the pushrod is connected to a first end 48 of a rocker arm 50 which is rotatably mounted on a shaft 52. A second end 54 of the rocker arm 50 is connected to a rocker link 56, which is connected to a hydraulic tappet 58 mounted at the upper end of the fuel injector 26. The cam follower 44, pushrod 46 and rocker arm 50 translate the camshaft rotational movement into the reciprocating movement required to move the injector plunger 34 to inject fuel into the combustion chamber 24.

A hydraulic fluid line 60 supplies hydraulic fluid to the tappet 58 in a manner which will be explained in more detail in connection with FIGS. 2 and 3 and causes a tappet fluid chamber to expand or contract by the axial movement of a tappet piston. This lengthens or shortens the drive train between the camshaft 38 and injector 26, which effectively changes the camshaft profile and the injector timing.

The crankshaft 20 and the camshaft 38 rotate in fixed timed relationship with the piston 14. When the drive train, which includes the camshaft 38, push rod 46, rocker arm 50 and rocker arm link 56, is in the relaxed mode illustrated in FIG. 1, the cam follower 44 is not raised by the camshaft lobe 40. The injector plunger 34 is retracted or raised, and fuel is metered into the injector, where some of it collects in the injector sac 32. Rotation of the camshaft lobe 40 raises the cam follower 44, and the drive train structures are caused to move so that the tappet 58 forms a solid link with the injector and presses against the injector plunger 34. The plunger point 36 is moved into the sac 32 to inject the metered fuel, which is under high pressure in the range of 20,000 psi, into the combustion chamber 24. The plunger is maintained in its depressed position for a predetermined time and under a predetermined pressure, depending upon the configuration of the camshaft lobe 40.

Injection timing is advanced by expanding tappet 58 hydraulically to lengthen the drive train, which alters the effective camshaft profile. When the drive train is relaxed, as in FIG. 1, hydraulic fluid is metered into the tappet from hydraulic line 60, which expands the tappet and extends the tappet piston structures as will be explained in detail below. Rotation of the camshaft lobe 40 would normally cause the drive train to move the injector plunger 34 into the sac 32 to inject fuel. However, the expanded tappet structures have lengthened the drive train, and the injector plunger will be forced into the sac at sufficiently high pressure to rupture the sac and destroy the injector unless the tappet contracts to a relaxed position after the fuel has been injected and the plunger tip is seated in the sac. In addition, combustion gases may escape into the fuel sac 32 or the injector may dribble fuel after injection instead of cleanly terminating injection unless the injector plunger 34 is maintained in its injection position at the predetermined time and pressure. Either of these events has an adverse effect on fuel economy and emissions levels.

The present invention addresses these problems and allows injection timing to be optimized by increasing the tappet blow down load. One embodiment of the hydraulic injector tappet of the present invention regulates and dampens tappet pressure to provide a constant load during blow down. Another embodiment of a hydraulic tappet according to the present invention includes a dampened load cell which controls dampening to allow the blow down pressure of the load cell to be increased.

Figure 2:
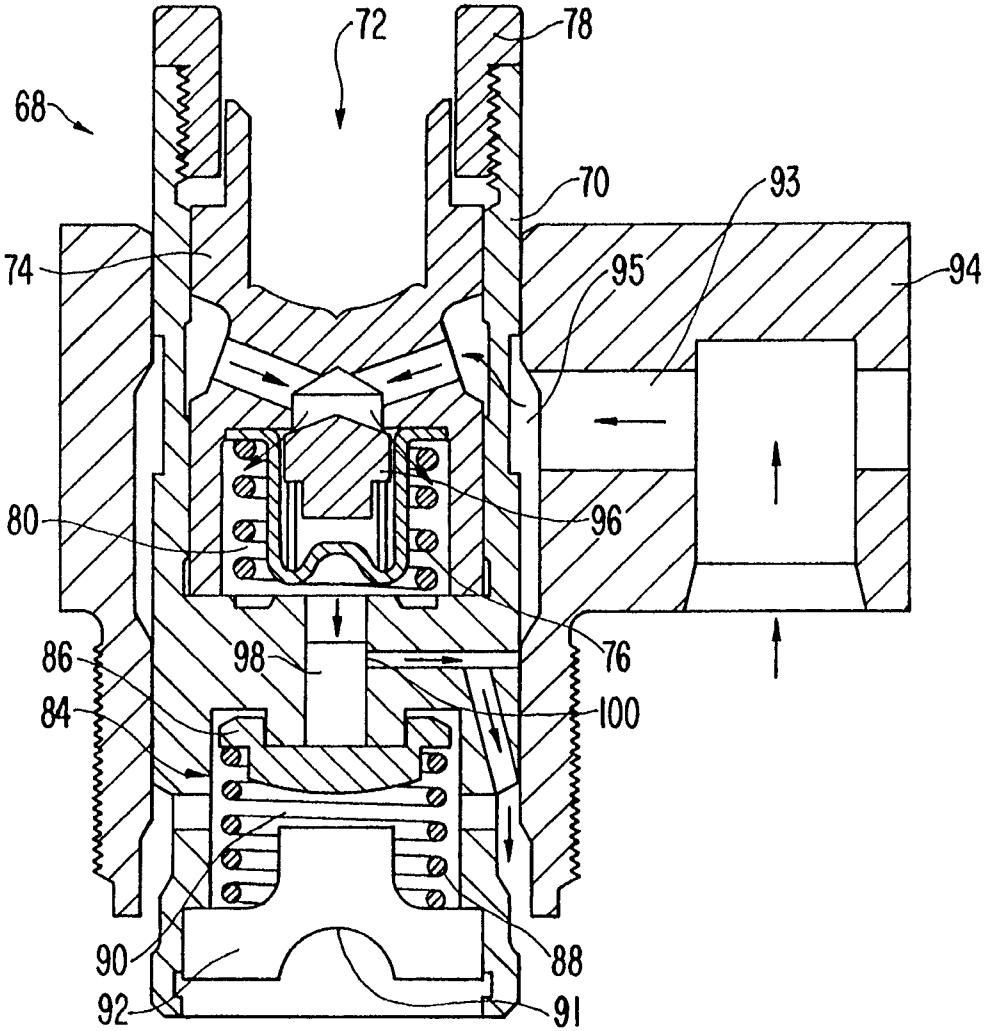
FIG. 2 is a schematic cross-sectional illustration of a fuel injector tappet which incorporates the dampened pressure regulating feature of the present invention.

FIG. 2 illustrates one embodiment of a hydraulic injector tappet 68 with a dampened pressure regulating function to improve fuel economy. The tappet is held in the cylinder head by a tappet sleeve 70. The rocker arm link 56 is configured to fit within a recess 72 to drivingly engage the tappet main piston or plunger 74. A tappet plunger spring 76 is biased to force the plunger toward the rocker arm link against a top stop nut 78. The plunger spring 76 is positioned in a plunger cavity 80. A second regulating plunger or piston 98 positioned between the tappet plunger 74 and a fuel injector plunger creates a load cell 84 which is used to regulate and dampen tappet pressure. A spring guide 86 guides a load cell spring 88 between expanded and contracted positions within a load cell spring cavity 90. An injector attachment 92 at the lower end of the load cell spring cavity is configured to include a socket 91 so that it can drivingly engage the upper end of a fuel injector plunger, such as plunger 34 shown in FIG. 1.

The dampened pressure regulating tappet of FIG. 2 operates to advance injection timing as follows: When the injector cam 40 (FIG. 1) is on the inner base circle (not shown), the injector plunger 34 and tappet 68 are each in a retracted position. The tappet plunger spring 76 forces the plunger or piston 74 upward against the top stop nut 78. Hydraulic fluid, which is preferably oil, flows into the tappet through a fluid inlet 93 in a stop screw 94 and then through a tappet inlet 95 and through a check valve 96 when the pop off pressure is exceeded to fill the plunger cavity 80. The stop screw 94 is preferably a one piece integrally formed structure. As the injector cam 40 continues to rotate and moves to the outer base circle (not shown), hydraulic fluid is trapped in the plunger cavity 80. This moves the tappet assembly and injector plunger downward. When the injector plunger is seated in the cup, the pressure in the plunger cavity 80 is increased.

When the pressure in plunger cavity 80 exceeds the force of the load cell spring 88 on a regulating plunger 98, the regulating plunger moves downward until it uncovers a spill port 100. The area of the spill port 100 is varied to equalize the pressure in the plunger cavity 80 and the load cell spring force by regulating the travel of the regulating plunger 98. The blow down pressure of the tappet is determined by the load of the load cell spring 88 when the regulating plunger 98 is at the upper edge of the spill port 100. The tappet load after blow down is determined by the area of the spill port 100 and the position of the regulating tappet 98. Hydraulic fluid is spilled from the plunger cavity 80 through the spill port 100 until the pressure inside the plunger cavity 80 is less than the load cell spring 88 load.

Hydraulic fluid flows through the tappet 68 generally along the path shown by the arrows in FIG. 2. The flow of hydraulic fluid permits regulation of the load during blow down so that it is constant. This prevents secondary injection by insuring that the injector plunger is fully seated. A higher load during blow down than could previously be achieved is also possible with this design.

The tappet design shown in FIG. 2 has a hydraulic fluid inlet 93 in the stop screw 94 that is larger than the fluid inlets of available hydraulic injector tappets. An increased fluid flow area at the tappet fluid inlet 95 is produced by this larger hydraulic fluid inlet. The configuration of the check valve 96 also creates a fluid flow area that is increased above that of available hydraulic tappet designs. Consequently, more fluid can flow into the plunger quickly, which shortens tappet recovery and response time.

Figure 3:
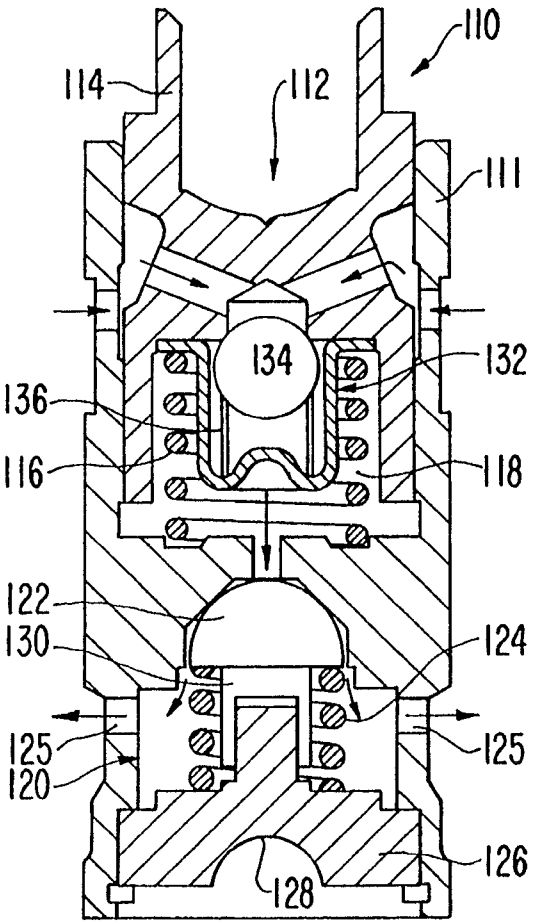
FIG. 3 is a schematic cross-sectional illustration of a fuel injector tappet which incorporates a dampened load cell in accordance with the present invention.

FIG. 3 illustrates a second embodiment of a hydraulic tappet 110 according to the present invention. FIG. 3 does not show a stop screw like the integral stop screw 94 shown in FIG. 2 which provides a fluid connection between the hydraulic fluid line 30 (FIG. 1) and the tappet fluid passages. However, a similar structure would be required to be mounted with the tappet so that the required fluid connections would be provided and the hydraulic tappet could function properly. A top stop nut 78 (FIG. 2) is likewise not shown, but would also be required to limit the tappet expansion.

The hydraulic tappet 110 of FIG. 3 is designed to increase the blow down load on the tappet while maintaining reasonable impact loads. The tappet 110, which is mounted in a sleeve 111, includes a suitably configured recess 112 to receive a rocker arm link 56 (FIG. 1) in the tappet plunger or main piston 114. A plunger spring 116, located in a plunger cavity 118, biases the plunger upwardly toward a top stop nut (not shown) like top stop nut 78 in FIG. 2. This tappet has a different load cell configuration than the tappet of FIG. 2. The load cell 120 includes a load cell plunger or piston 122 that is biased by a load cell spring 124 toward the plunger cavity 118. A socket 126, which is drivingly engaged by the load cell plunger 122, includes a recess 128 configured to receive the upper end of a fuel injector plunger (not shown). A dampening cavity 130 is formed below the load cell plunger and interiorly of the load cell spring 124.

In operation, when the injector cam 40 (FIG. 1) is on the inner base circle (not shown), the injector plunger 34 and tappet 110 are retracted upward. The tappet plunger spring 116 forces the tappet plunger 114 upward against a stop (not shown). Hydraulic fluid flows into the tappet through a spring loaded inlet check valve 132. This valve may be the ball-type valve shown in FIG. 3, the arrowhead-shaped check valve shown in FIG. 2, or another convenient check valve configuration suitable for an internal combustion engine hydraulic fuel injector tappet. In FIG. 3 the check valve 132 includes a ball 134 biased by a spring 136. When the pop off pressure is exceeded, hydraulic fluid will flow through the check valve 132 to fill the plunger cavity 118. When the injector cam is on the outer base circle, hydraulic fluid is trapped in the plunger cavity 118. The injector plunger 34 (FIG. 1) is caused to move downward with the moving tappet structures so that the injector plunger tip 36 is seated in the injector tip 28. When the injector plunger is fully seated, the pressure in plunger cavity 118 is increased.

When the pressure in the plunger cavity 118 is greater than the load cell spring 124 force on the load cell plunger 122, the load cell plunger moves downward, which spills oil to the drain 125. The dampening cavity 130 formed by the load cell plunger 122 and lower socket 126 slows the movement of the load cell plunger 122 and controls the impact load. This dampening control allows the blow down pressure of the load cell to be increased, which provides more control over the advance of injection timing.

The hydraulic fluid, which is preferably lubrication oil, generally follows the path of the arrows through the FIG. 3 hydraulic tappet.

Figure 4A:
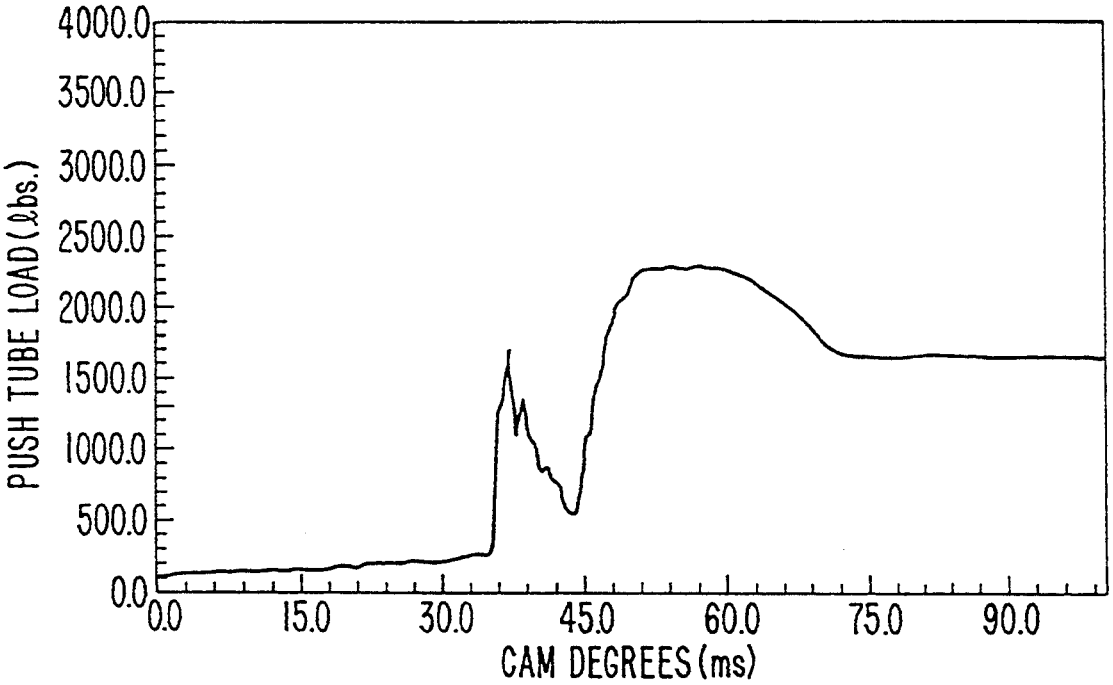
FIGS. 4*a* and 4*b*, respectively, illustrate graphically the relationship between push tube load and cam rotation for a tappet without the dampened pressure regulating feature of the present invention and a dampened pressure regulating tappet according to the present invention.
Figure 4B:
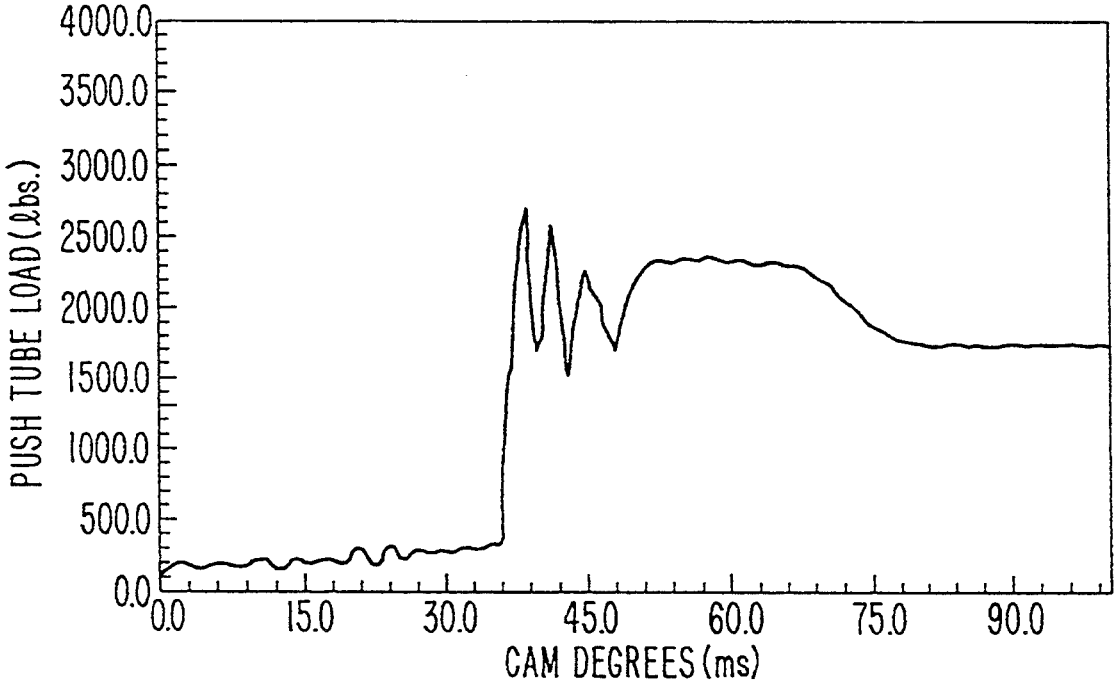

FIGS. 4*a* and 4*b* illustrate, graphically, the improvements in load cell pressure which result from the dampened hydraulic tappet of the present invention. FIG. 4*a* shows the push tube or tappet load cell load in pounds for zero to over ninety cam degrees for a prior art hydraulic tappet without the pressure regulating or dampening features of the present invention. FIG. 4*b* illustrates the same relationship for the hydraulic tappet embodiment of FIG. 2. In both cases, the measurements were made at 700 RPM for a single cylinder. The improvements in load increase produced by the present invention are clearly apparent from FIGS. 4*a* and 4*b*. The increased load allows the injection timing to be optimally advanced, which results in improved fuel economy, reduced metering chamber temperatures and reduced injector carboning and corrosion.

Industrial Applicability

The present invention will find its primary application in fuel injector drive trains of compression ignition or diesel internal combustion engines. However, the dampened hydraulic tappet structure described herein could also be used in other drive trains, such as those used to drive valves, wherein precise control of a timed event is desired.

We claim:

1. An expandable hydraulic tappet for use in a camshaft-driven internal combustion engine drive train for selectively varying the effective profile of the camshaft by extending the effective length of the drive train between the camshaft and a fuel injector, said tappet comprising:
   (a) a tappet housing having a bore therein and stop means for limiting the expansion of said tappet;
   (b) a tappet body disposed within said housing bore having a first end operatively connected to the camshaft and a second end operatively connected to a unit fuel injector and a central body section disposed between said first and second ends, said central body section including a fluid inlet connected to a source of hydraulic fluid, a fluid outlet, a first chamber proximate to said first end and said fluid inlet and a second chamber proximate to said second end and said fluid outlet and fluidically connected to said first chamber;
   (c) a first piston reciprocally moveable within said first chamber between said fluid inlet and said stop means capable of forming a hydraulically-tight seal with said first chamber;
   (d) a second piston reciprocally moveable within said second chamber; and
   (e) a spring biased pressure responsive valve disposed between said fluid inlet and said first chamber and between said first and second pistons; and
   (f) load cell means positioned in said second chamber between said second piston and said second end for determining the tappet load.

2. The hydraulic tappet described in claim 1, wherein said first piston is biased against said stop means by a first piston spring mounted proximate to said valve in said first chamber when a corresponding injector cam is on an inner base circle on the camshaft.

3. The hydraulic tappet described in claim 2, wherein said load cell means includes a load cell spring proximate to said second end.

4. The hydraulic tappet described in claim 3, wherein the movement of said second piston is controlled by said load cell spring to cover and uncover said outlet.

5. The hydraulic tappet described in claim 3, wherein said second chamber further includes dampening cavity means for controlling the impact load of said second plunger.

6. They hydraulic tappet described in claim 5, wherein said dampening cavity means is positioned between said second plunger and said second end of said tappet body.

7. The hydraulic tappet described in claim 1, wherein said first piston is configured to receive a link from said drive train and said second end includes socket means for engaging said fuel injector plunger.

8. An expandable hydraulic tappet for use in a camshaft-driven internal combustion engine drive train for selectively varying the effective profile of the camshaft by extending the effective length of the drive train between the camshaft and a high pressure unit fuel injector, said tappet comprising:
   (a) a tappet body including a fluid inlet connected to a fluid outlet by selectively opened fluid passages mounted in a tappet sleeve;
   (b) integral fluid connection means for providing a flow of hydraulic fluid from the engine through the fluid passages in the tappet body;
   (c) a spring biased main tappet piston including a cavity to receive said biasing spring connected to the drive train and moveable axially against a stop at one end of the tappet sleeve in response to fluid pressure inside the tappet body;
   (d) a load cell located adjacent to the other end of the tappet sleeve;
   (e) a spring biased regulating piston moveable axially to permit fluid to flow from the fluid outlet in response to pressure in the load cell;
   (f) a valve disposed between said main tappet piston and said regulating piston movable to trap fluid in the tappet body to cause the effective length of the hydraulic tappet to expand;
   (g) a drive train receptor located in said main tappet piston; and
   (h) an injector receptor located adjacent to said load cell.

9. The expandable hydraulic tappet described in claim 8, wherein said load cell includes an axial spring and a spring guide positioned within a spring cavity at one end of said spring.

10. The expandable hydraulic tappet described in claim 9, wherein said spring guide contacts one end of said regulating piston to normally bias said regulating piston to a position covering the fluid outlet.

11. A method of selectively varying the effective profile of the camshaft in a camshaft-driven internal combustion engine drive train which includes the expandable tappet of claim 8 operatively connected between the drive train and the injector, said method including the steps of:
   (a) when a corresponding injector cam is on an inner base circle on said camshaft and said main tappet piston is biased against said stop, causing hydraulic fluid to flow through said integral fluid connection means into the tappet body fluid passages and through said valve to fill the cavity in said main tappet piston;
   (b) trapping fluid in said main tappet piston cavity as the injector cam rotates to an outer base circle, causing the tappet body to move away from said stop and to seat a plunger within the fuel injector, thereby increasing the pressure in said main tappet piston cavity;
   (c) when the pressure in said main tappet piston cavity exceeds the force of the spring biasing said regulating piston, causing said regulating piston to move axially from a position covering said fluid outlet to a position uncovering said fluid outlet; and (d) regulating the axial movement of the main tappet piston relative to the injector plunger to vary the effective length of the drive train by regulating the axial movement of said regulating piston relative to said fluid outlet.

12. An expandable tappet for use in a cam shaft-driven internal combustion engine drive train for selectively varying the effective profile of the camshaft by extending the effective length of the drive train between the camshaft and a high pressure unit fuel injector, said tappet comprising:

(a) a tappet body mounted in a tappet sleeve and including a fluid inlet connected to a fluid outlet by a selectively opened fluid passages;

(b) integral fluid connection means for providing a flow of hydraulic fluid from the engine through the fluid passages in the tappet body;

(c) a spring biased main tappet piston connected to the drive train and moveable axially against a stop at one end of the tappet sleeve in response to fluid pressure inside the tappet body;

(d) a load cell located adjacent to the other end of the tappet sleeve;

(e) a load cell piston moveable axially within the load cell; and (f) dampening control means for modulating the movement of said load cell piston.

13. The expandable tappet described in claim 12, wherein said dampening control means comprises a dampening cavity in said load cell.

14. The expandable tappet described in claim 13, wherein said load cell includes an axial spring positioned exteriorly of said dampening cavity.

15. The expandable tappet described in claim 14, wherein said tappet body is operatively connected to a unit fuel injector plunger.

* * * * *